US006558075B2

(12) United States Patent
Benedict et al.

(10) Patent No.: US 6,558,075 B2
(45) **Date of Patent: *May 6, 2003**

(54) PERMANENT AND SEMI-PERMANENT GROYNE STRUCTURES AND METHOD FOR SHORELINE AND LAND MASS RECLAMATION

(75) Inventors: Charles E. Benedict, Tallahassee, FL (US); James R. Dobbs, Tallahassee, FL (US); Perry L. Ponder, Tallahassee, FL (US)

(73) Assignee: Beach Reclamation, Inc., Tallahassee, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/852,035

(22) Filed: May 10, 2001

(65) Prior Publication Data

US 2002/0168228 A1 Nov. 14, 2002

(51) Int. Cl.[7] ..... E02B 3/04
(52) U.S. Cl. ..... 405/21; 405/15; 405/32; 405/34; 405/302.7; 256/12.5
(58) Field of Search ..... 405/21, 22, 24, 405/25, 28, 32, 35, 15, 302.6, 302.7; 256/12.5

(56) References Cited

U.S. PATENT DOCUMENTS

| | | | |
|---|---|---|---|
| 449,185 | A | 3/1891 | Solomon |
| 1,060,357 | A | 4/1913 | Nies |
| 1,165,906 | A | 12/1915 | Rhoades |
| 1,572,732 | A | 2/1926 | McCammack |
| 2,341,515 | A | 2/1944 | Rehfeld |
| 4,089,179 | A | 5/1978 | Trautman |
| 4,688,024 | A | 8/1987 | Gadde |
| 4,710,056 | A | 12/1987 | Parker |
| 4,738,563 | A | 4/1988 | Clark |
| 4,861,193 | A | 8/1989 | Newkirk |
| 5,255,997 | A | 10/1993 | Bailey et al. |
| 5,348,419 | A | 9/1994 | Bailey et al. |
| 5,720,573 | A | 2/1998 | Benedict et al. |
| 5,944,443 | A | 8/1999 | Benedict |

FOREIGN PATENT DOCUMENTS

| | | |
|---|---|---|
| IT | 565640 | 8/1957 |
| JP | 61216917 | 9/1986 |
| SU | 1300074 | 9/1985 |

*Primary Examiner*—Frederick L. Lagman
(74) *Attorney, Agent, or Firm*—Dowell & Dowell, P.C.

(57) ABSTRACT

Porous groynes for shoreline reclamation which include a plurality of spaced stanchions and at least one self supporting screen grid having a plurality of openings therein through which fluid and fluid conveyed solids may pass and wherein the screen grid means is formed of a high density polyethylene, polypropylene, polymers, co-polymers, polymer mixtures or laminates.

17 Claims, 7 Drawing Sheets

PERMANENT AND SEMI-PERMANENT GROYNE STRUCTURES AND METHOD FOR SHORELINE AND LAND MASS RECLAMATION

CROSS REFERENCE TO RELATED APPLICATIONS

This application claims priority from U.S. patent application Ser. No. 09/828,241 which was filed on Apr. 9, 2001 now U.S. Pat. No. 6,481,926; which is a CIP of U.S. patent application Ser. No. 09/385,360 which was filed on Aug. 30, 1999 and is now abandoned; which was a CIP of U.S. patent application Ser. No. 09/027,549 which was filed on Feb. 23, 1998 and issued as U.S. Pat. No. 5,944,443; which is a CIP of U.S. patent application Ser. No. 08/582,253 which was filed on Jan. 3, 1996 and issued as U.S. Pat. No. 5,720,573.

BACKGROUND OF THE INVENTION

1. Field of the Invention

The present invention is directed to porous groyne-like structures and method for their use in reclaiming beaches, shoreline areas and other land masses which are subject to erosion by natural forces and, more specifically, to permanent and semi-permanent groyne structures which may be left in place when deployed or selectively vertically raised during use. In some embodiments the groynes may be systematically raised as reclamation progresses from the buildup of silt, sand, shells, dirt, twigs and branches, grasses and other materials.

2. Description of Related Art

Beach and other shoreline erosion, especially in coastal areas, is a major concern to property owners who have residences or establishments which are situated in close proximity to the shoreline. Not only is there a tremendous personal and economic loss caused by damage to, or loss of, real estate, housing and commercial buildings by shoreline or beach erosion, but there is also recreational loss of waterfront property which adversely affects the general public.

To deter coastal erosion in many areas, large seawalls are constructed to prevent high tides from reaching land and property. Such structures are costly and are only practical when population densities make it economically reasonable to construct them. Further, such structures have an adverse effect on the natural appearance of the shoreline and, in many areas, cannot be practically constructed.

Other methods of shoreline reclamation include creating jetties or artificial barriers or reefs which extend from the shoreline. These structures are permanent installations and are generally utilized to prevent sand along coastal areas from washing out to sea by wave action. Like seawalls, however, such structures are costly to construct and maintain and, in some areas, are not appropriate for use due to the shoreline configuration, prevailing currents or tidal activity and the like. Also, such structures create a safety hazard in areas where recreational activity is anticipated A further method for reclaiming shoreline areas and preventing erosion is the placement of off-shore, underwater barriers. Often, large porous structures are placed along a sea floor or riverbed at some distance from the existing shoreline. The structures are provided to break wave, current or tidal action thereby creating a zone of low velocity water flow adjacent a beach or riverbank so that sand, silt and other particulate material will settle out of the water before being conveyed by fluid currents out from the shoreline. Again, such outer barriers are only appropriately used in some locations and are not appropriate for use in many locations and may be objectionable for use in some areas due to the adverse affect on aquatic life.

Other methods which are widely used to reclaim shorelines or beaches are dredging and sand importation. When major dunes along a shoreline are damaged or washed away during heavy storms, it is often necessary to import new dirt and sand to re-establish the dunes to provide a natural barrier to tidal activity. Dredgers are commonly utilized to pump sand from a sea floor or riverbed to build up natural barriers. Such methods of shoreline reclamation, however, are temporary measures, at best, and do not provide a long-term solution to shoreline erosion. Further, such restoration methods are extremely costly and are not practical in many locations.

In view of the foregoing, there is a need to provide a method and apparatus for economically reclaiming damaged shorelines, and other land mass beach areas which can be practically used without an adverse effect to either land or water environments. In U.S. Pat. Nos. 1,969,123 and 4,710,056, methods and structures for beach restoration are disclosed which utilize netting for purposes of trapping sand, shells and other particulate matter carried by wave action. Nets are extended outwardly from the shoreline and are left in place until a buildup of sand and other particulate matter is established after which the nets, which may be buried several feet or more in the newly collected material, are withdrawn by winches or other means. The removal of the netting material can adversely affect the restored shoreline by creating trenches or furrows which form natural channels in which water flows away from the shoreline thereby conveying particulate matter back to a body of water.

In prior U.S. Pat. Nos. 5,720,573 and 5,944,443, screen or netting structures for groynes are disclosed wherein the screens are periodically raised as material is deposited during reclamation so as to reduce interference with newly deposited materials. During use, flexible materials such as screening and netting are effective for material build-up, however, under some deployment conditions such as during violent storms and sea surges, such groyne structures can be significantly damaged. Damage to screening or netting mandates added cost for required repair and replacement in order to maintain an effective groyne system.

Also, many groyne systems, such as described in the aforementioned patents, are specifically designed to be removably deployed. In some areas, such as along coastal or other shorelines it may be more beneficial to deploy or erect groyne systems which are designed to be semi-permanent or permanent. Such groyne systems must be constructed to with stand the forces encountered including wind, wave and tidal action over extended periods of time.

SUMMARY OF THE INVENTION

The present invention is directed to a method and apparatus for reclaiming shoreline, beach and offshore areas which includes the installation of semi-permanent or permanent groyne structures defined having a plurality of posts or stanchions which are embedded in a sea floor, or in other areas, so as to be in spaced relationship with respect to one another, such as extending from a shoreline to an off shore area and between which are mounted one or more porous screens. The stanchions may be generally aligned in spaced relationship with one another or may be staggered in offset relationship. In some preferred embodiments, the stanchions may be placed in sets which include at least two end stanchions to which the screens are secured. As used herein, the term shoreline refers to both land and off shore bottom areas including beaches and banks situated along lakes, rivers, inlets, bays, seas, oceans and the like, it being the express purpose of the invention to build-up solid material deposits both on and off shore.

The screens of the present invention are formed in the preferred embodiments of a molded, laminated or extruded open plastic mesh or open grid material. A preferred material is Tensar Geo-grid® which is an integrally formed grid structure manufactured of stress resistant high density polyethylene or polypropylene or other polymers, co-polymers or polymer mixtures or laminates thereof and sold by Earth Technologies, Inc. of Atlanta, Ga. Such grids can be formed to provide uniaxial properties or biaxial properties with the mesh openings between cross-members of the grids varying in size depending upon anticipated use.

The screens are mounted on stanchions or poles which are embedded into the sea floor or into other soil preferably by clamping or otherwise securing end edges of separate screens to sleeves which are slidably disposed about the spaced stanchions. In this manner, when the screens are originally installed, the lower edges thereof rest on and become temporarily embedded in deposited material forming a new land mass. The screens can be left in place when deployed or they may be elevated with respect to newly deposited material such that the lower edges rest on or remain slightly embedded in the newly deposited material. Means for elevating each screen may include hoists, cranes and the like which are positioned adjacent the groyne structures. The hoist may be selectively secured to either the sleeves or to the screen material in order to provide a lifting force so as to slide the supporting sleeves vertically upwardly relative to the spaced stanchions.

To further facilitate the manner in which the screens of the present invention may be elevated, in preferred embodiments, each screen is secured at its ends to stanchions on the sleeves not supporting other screens, however, in some embodiments the stanchions or sleeves may support adjacent screens in end-to-end relationship. In some embodiments, when separate pairs of end stanchions are used to support separate screens in generally end-to-end relationship, adjacent stanchions of the pairs may be connected to one another such as by clamps, rings or other connections such that the forces directed against one of the joined stanchions are distributed to, and resisted by, the other stanchions.

As a further improvement, in some embodiments, each screen may be subdivided into separate vertical sections each of which may be secured to a plurality of separate sleeves movably mounted on end supporting stanchions. In this manner, as the screen sections are raised, the uppermost sections can be removed from the groyne structure as is necessary.

Whether or not a single vertical screen or a plurality of vertical screens are used between spaced stanchions, in preferred embodiments the mesh openings of the screens should be smaller adjacent the lower portion of the groyne structures, although in some embodiments the mesh opening may be uniformed throughout the groyne structures. Further, the mesh openings may be of varied configuration and may be elongated and non-rectangular, rectangular, square or other configuration and be within the teachings of the present invention. The size of the mesh openings, may vary. The openings may be created by forming the mesh openings at varied dimensions during manufacture or may be constructively formed by overlapping separate screen grids so as to define openings of different sizes. This can be accomplished by placing two screen grids in face-to-face relationship with respect to one another such that their openings are not aligned and securing such face-to-face screens to sleeves slidably mounted on common end stanchions.

As a variation of the preferred embodiment, the screen grids may be formed so as to permit a weaving of either the sleeves or the stanchions between vertically spaced openings in each screen. In this manner, a screen may be directly secured without mechanical fasteners to a stanchion or to a sleeve slidably mounted on a stanchion. This may be preferred where a screen has a significant horizontal length so as to allow an intermediate portion of the screen to be secured in a relatively inexpensive manner to an intermediate stanchion.

As opposed to directly mounting the screens to the sleeves or stanchions of the invention, various fasteners may be utilized to secure portions of the screens directly to the sleeves or stanchions. Such fasteners may be clamps constructed of plastics or metal. Further, the sleeves may be cylindrical sleeves or may be molded sleeves having flanges which may be secured to the ends of the screens. In some embodiments, the sleeves may be formed as split sleeves having outwardly extending flanges between which an end portion of a screen may be secured, such as by of the use of bolts or other fasteners, fusing, welding or other means.

Utilizing the methodology of the present invention, a plurality of spaced groyne structures are positioned so as to extend in spaced relationship with respect to one another such as outwardly from a shoreline. The orientation between the groyne structures and the angular relationship with respect to other areas or land masses, such as a shoreline, will be dictated by the specifics of a given area including winds, currents, tidal activity and the like. Once the screens have been secured to the stanchions, the screens may be left in place as semi-permanent or permanent structures or they may be elevated periodically as deposits are formed so as not to become too deeply embedded in the newly deposited material and thus not disturb the newly deposited material.

It is the primary object of the invention to provide a method and apparatus for economically reclaiming land including along shorelines and off shore areas of oceans, gulfs, inlets, bays, rivers, lakes as well as other areas where currents, tidal and/or wind activity is experienced and wherein the structures exhibit permanent or semi-permanent characteristics being sufficiently strong and rigid to withstand stresses imparted thereto by strong storm surges and heavy tidal activity.

It is a further object of the invention to provide groyne structures and a method for installing such structures wherein the structures may be temporarily installed and removed after land has been reclaimed without disturbing the natural contour of the reclaimed land.

It is also an object of the invention to provide groyne structures to reclaim land which are environmentally compatible and which will not deteriorate by exposure to normal environmental conditions including ultra-violet light or sea water.

BRIEF DESCRIPTION OF THE DRAWINGS

A better understanding of the invention will be had with respect to the attached drawings wherein.

DESCRIPTION OF THE PREFERRED EMBODIMENT

Figure 1:
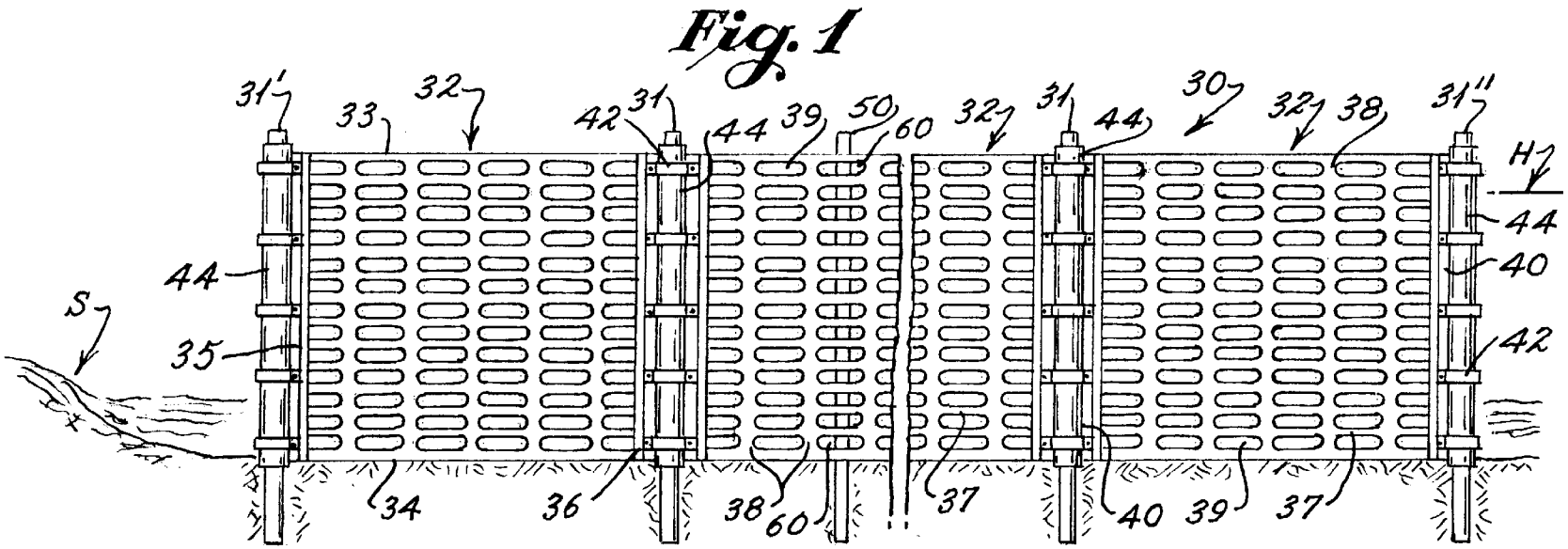
FIG. 1 is a front elevational view having portions broken away of a groyne constructed in accordance with the invention showing a plurality of separate screen grids being mounted to spaced stanchions by way of sleeves removably mounted about the stanchions.

With continued reference to the drawing figures, a groyne 30 of the present invention will be shown as being deployed along a shoreline "S" of a gulf, ocean, lake, river or the like such that the structure extends from the shoreline to off shore with the height of the structure being such that the screens of the structure extend generally above or below the water surfaces, such as above the high tide line "H". The groyne structures are specifically constructed so that they may be permanent or semi-permanent or, when environmental or other conditions require, the structures may also be readily removed or adjusted so as to not adversely affect movement of aquatic life.

Each groyne structure 30 includes a plurality of spaced stanchions, posts, or poles 31 which are preferably formed of a non-corrodible material such as galvanized pipe having lower ends which are inserted into a sea floor "F" in any appropriate manner such as by vibration, jetting, drilling and the like. The stanchions may be spaced at varying distances with respect to one another and extend generally perpendicularly or angularly outwardly from the shore "S" to a point off shore. For purposes of description, the innermost stanchion is designated as 31' and the outermost stanchion as 31". As shown in FIGS. 15, 17, 22 and 23 in preferred embodiments, the stanchions intermediate the innermost and outermost stanchions may be placed adjacent to or in close proximity of one another in sets of at least two end stanchions for purposes of separately supporting screen grids 32 which extend between the stanchions. In this manner, each screen grid 32 is supported by separate stanchions such that each screen may be independently vertically maneuvered without effecting the positioning of an adjacent screen grid.

The screens of the invention are formed of a plastic geogrid material or of a geotextile and plastic laminate material in which the length of each screen may vary. In preferred embodiments, the screen sections should be approximately 10 to 20 feet in length and may vary from 4 to 10 feet in height. In this respect, the stanchions 31 will be spaced generally in equal increments with the exception of adjacent stanchions which support the end portions of adjacent end-to-end screens.

Each screen grid 32 includes an upper edge 33 a lower edge 34 and opposite side or end edges 35 and 36. The screens are molded, laminated, pultruded, or slit and pulled or otherwise configured extruded into open mesh structures. The configuration of the openings shown at 39 in FIG. 1 may vary as will be described in detail. The resulting screen structures generally include a plurality of horizontal components 37 which are integral with a plurality of vertical components 38. A preferred material is Tensar Geo-grid® which is an integrally formed grid structure manufactured of stress resistance high density polyethylene, polypropylene or other polymers, co-polymers or polymer mixture or laminates thereof and which are sold by Earth Technology, Inc. of Atlanta, Ga. The material from which the screens are formed should be treated to provide resistance to ultra-violet deterioration and not deteriorate by prolonged exposure to salt water.

The screen grids 32 shown in FIG. 1 show openings 39 of generally uniformed size throughout. However, it is envisaged that the openings may not be uniformed throughout each screen. In some embodiments, the openings along the lower portion of the screens may be formed so as to be smaller in dimension than openings in upper portions of the screens in order to be more effective in creating deposits of finer particulate materials along the base of the screens when the screens are deployed as shown in FIG. 1. It is generally preferred that the minimum dimension of the openings not exceed generally one inch and the openings shown in the drawings are somewhat exaggerated in size and are not drawn to scale.

One of the features of the screens of the invention is that they exhibit a great deal of strength and yet offer some flexibility along their length so that each section is easily handled to facilitate installation. However, the overall screens are self supporting and are thus substantially rigid enough to resist forces applied substantially in any direction relative thereto.

Figure 4:
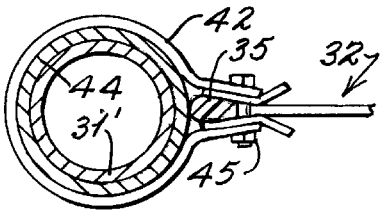
FIG. 4 is a cross-sectional view taken along line 4—4 of FIG. 3.
Figure 5:
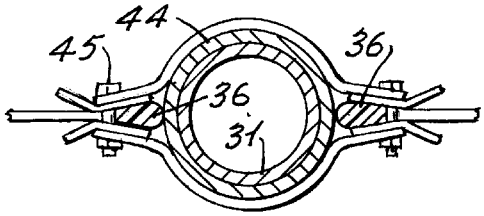
FIG. 5 is a cross-sectional view taken along line 5—5 of FIG. 3.
Figure 16:
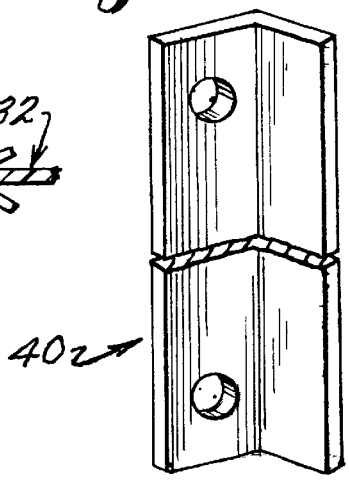
FIG. 16 is a perspective view having portions broken away of one of a pair of elongated clamps which may be used to secure the end edges of each screen to a sleeve or stanchion of the invention.
Figure 17:
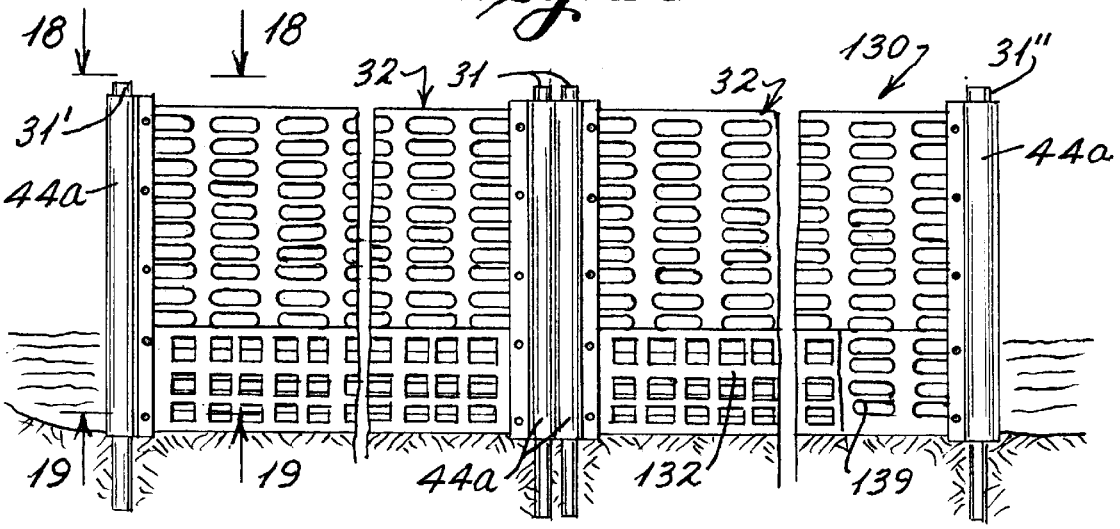
FIG. 17 is a front elevational view having portions broken away showing a further modification of the porous groyne system of the invention wherein, in order to create different sized openings in the groyne structure, separate screen grids are placed in face-to-face relationship with the mesh openings therein not in alignment, thus varying the effective mesh openings, especially along a lower portion of the groyne.
Figure 18:
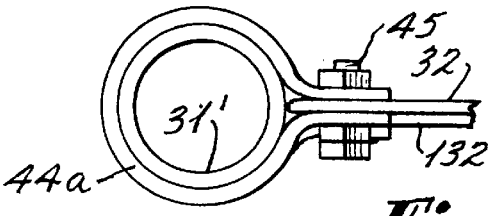
FIG. 18 is a view taken along lines 18—18 of FIG. 17.
Figure 19:
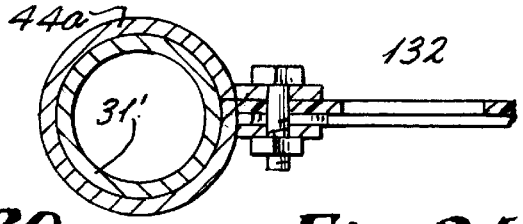
FIG. 19 is a cross-sectional view taken along line 19—19 of FIG. 17.
Figure 20:
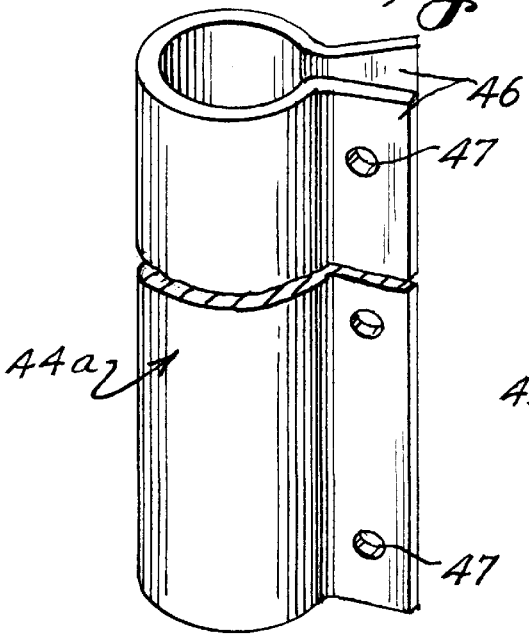
FIG. 20 is a partial perspective view of a split sleeve which may be used to secure the end edges of the screens of the invention to the stanchions.

In the embodiment shown in FIG. 1, the end edges 35 and 36 of each screen are clamped between elongated and opposing clamp members 40, see FIG. 16, which are somewhat "V" shaped in cross section to facilitate engagement with the tapered edges of the ends 35 and 36 of the screen, as shown in FIGS. 4 and 5. The clamp members are urged against the end edges by band clamps 42 which are mounted about sleeves 44 which are of a size to be slidably received about the stanchions 31. Bolts or other fasteners 45 extend through aligned openings in the band clamps 42 and in the clamp members 40 in order to secure the end edges of the screens to the sleeves 44.

The sleeves 44 may be formed of substantially any material which exhibits resistance to deterioration by exposure to salt water and ultra-violet light such as a suitable plastic material. It is preferred that the sleeves are slidable relative to the stanchions so as to permit a selected vertical elevation of the sleeves relative to the stanchions to permit raising of the screens as may be required. As shown, a number of clamps 42 may be used to secure the ends of each screen 32 to a sleeve 44.

With specific reference to FIGS. 17–20, a different embodiment of sleeve 44*a* is disclosed in the form of a split sleeve. The split sleeve 44*a* includes a pair of elongated flanges 46 which are integrally molded with the remaining portion of the sleeve and which have a plurality of spaced openings 47 therein for purposes of receiving the locking bolts 45. In this manner, the split sleeve structures can be utilized as a common clamp and sleeve thereby facilitating the ease and manner in which the end edges of each screen may be secured to the spaced stanchions. Utilizing the split sleeve, not only are the band clamps 42 not necessary to secure the end edges of each screen to a stanchion, but the opposing clamp members 40 are also not necessary as the end edges may be directly secured to the spaced and opposing flanges of the split sleeve.

Figure 21:
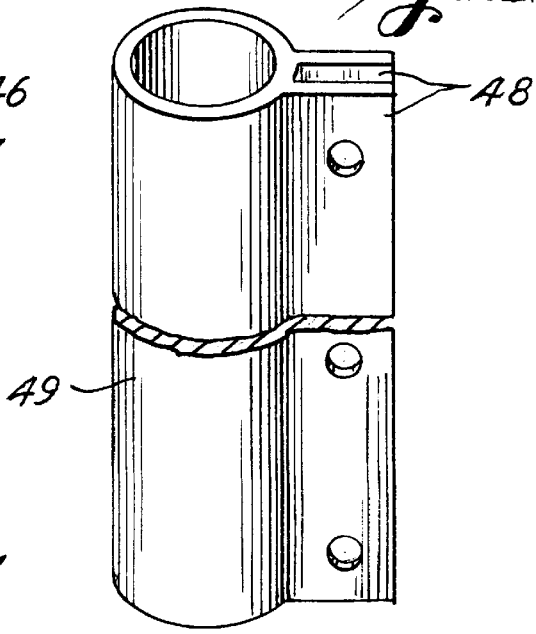
FIG. 21 is a perspective view with portions broken away of an alternate embodiment of sleeve which may be utilized to secure the screens of the invention to the stanchions.

With specific reference to FIG. 21, another embodiment of sleeve 44*b* is shown. In this embodiment, the sleeve is extrusion molded to provide a pair of spaced flanges 48 which extend outwardly from an integral tubular body 49. In this embodiment, the end edges of a screen may be secured between the flanges 48 either by separate fasteners such as bolts 45, ultra-sonic welding or adhesively securing the end edges between the spaced flanges 48. In some embodiments a single flange 48 may be used.

Regardless of the manner in which the end edges of each screen 32 are secured to the sleeves, when the screens are secured, they are generally rigid between the spaced stanchions so as not to yield laterally, sag, stretch or otherwise be displaced by wave or tidal activity.

With specific reference to FIG. 1, in some deployments, it is possible that some screens may be of such a length as to require an intermediate support between sleeves mounted on spaced stanchions. In this respect, either secondary stanchions or supplemental posts 50 may be provided intermediate the normally deployed stanchions. An intermediate portion of the screen between its opposite ends may be secured to the supplemental post or stanchion 50. In FIG. 1, a first manner in which the screens may be secured to an intermediate stanchion is by interweaving the stanchion between enlarged openings 60 formed in the screen. In such instances, during manufacture, openings can be formed in vertical alignment which are of a size to allow the screen to be interweaved about the stanchion 50 when installed. This will allow the intermediate stanchion 50 to provide extra support for the screen without requiring mechanical fasteners.

Figure 6:
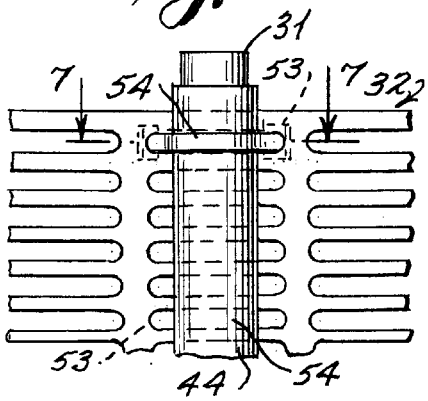
FIG. 6 is a view of an alternate securing device for securing the screen grids to the sleeves or stanchions of the present invention.
Figure 7:
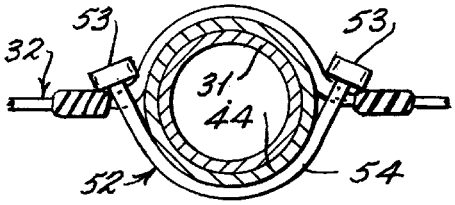
FIG. 7 is a cross-sectional view taken along lines 7—7 of FIG. 6.
Figure 8:
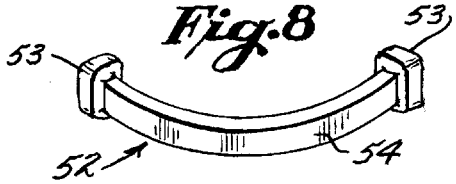
FIG. 8 is a perspective view of the fasteners shown in FIGS. 6 and 7.

As opposed to using an interweaving to secure the intermediate portion of a screen to an intermediate stanchion, and as shown in FIGS. 6–8, plastic or metal locking ties or fasteners 52 may be used. As shown in FIG. 6, a generally flexible locking tie 52 extends around a sleeve 44 mounted to an intermediate post or stanchion. The opposite ends of the fastener 52 are enlarged as shown at 53 such that they can be inserted within the elongated openings 36 and thereafter rotated 900 in order to prevent withdrawal of the ends 53 through the openings 39. In this respect, the intermediate body portion 54 of the fasteners 52 must permit a twisting motion to be applied without destroying the integrity of the fasteners.

Figure 2:
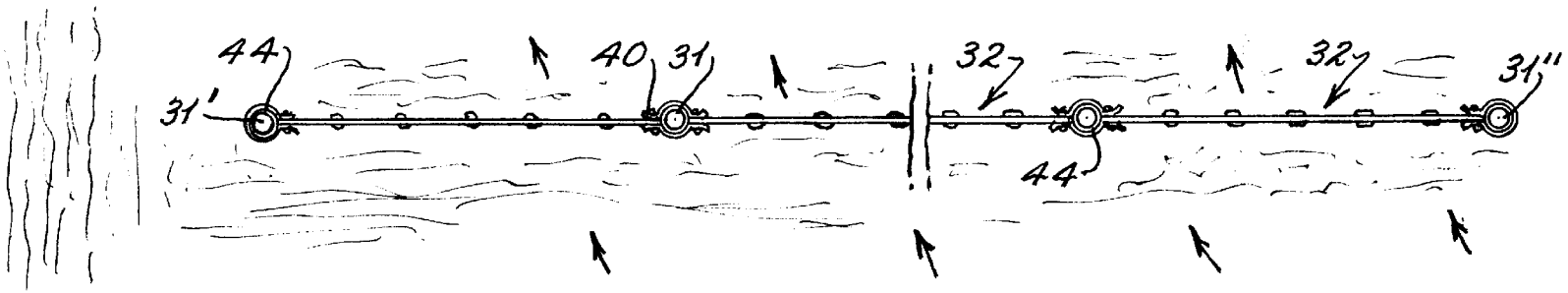
FIG. 2 is a top plan view of the groyne system of FIG. 1.
Figure 3:
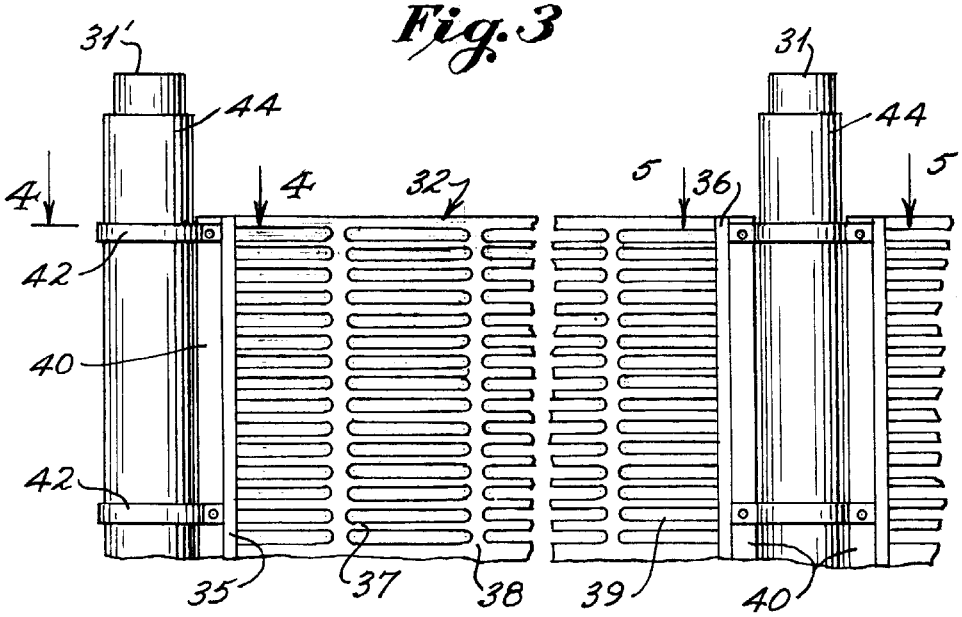
FIG. 3 is an enlarged partial section of one screen grid of FIG. 1 showing the mounting of the screen to sleeves disposed about the spaced stanchions.
Figure 22:
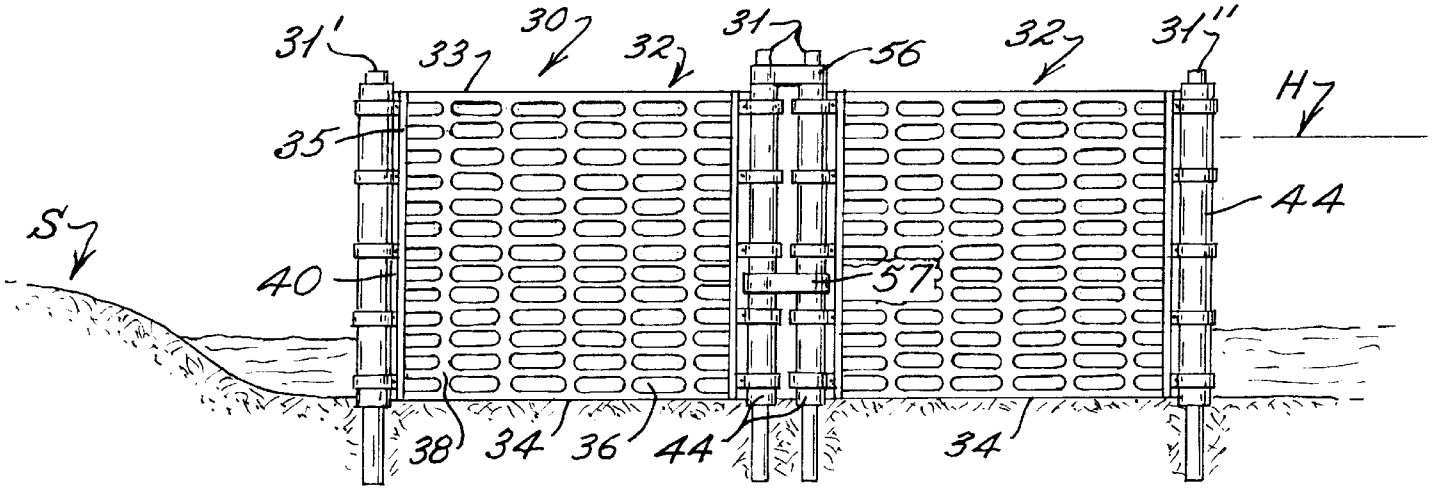
FIG. 22 is a front elevational view of the groyne structure of FIGS. 1 and 2 showing a varied deployment of the stanchions and screen sections.
Figure 23:
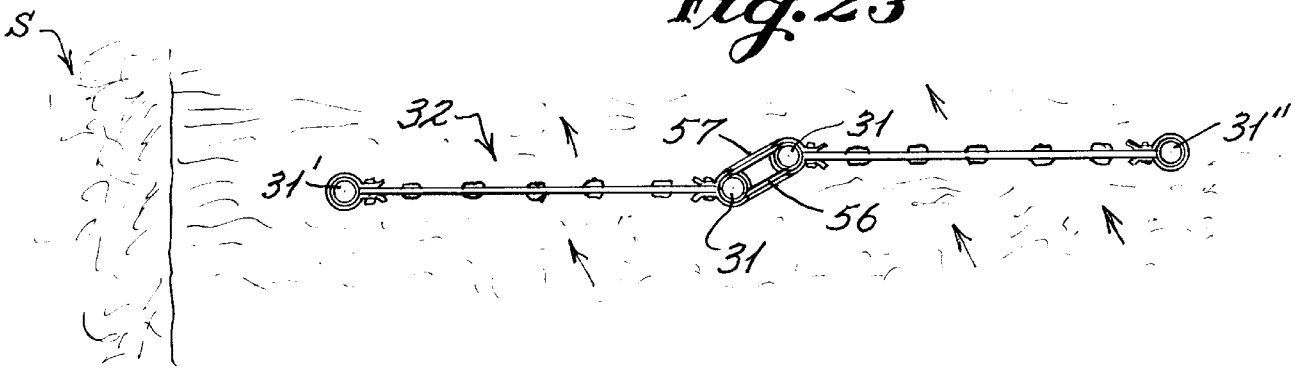
FIG. 23 is a top plan view of the groyne deployment of FIG. 22.

The stanchions and the screen grids of the invention may be deployed in a generally linear alignment as shown in FIGS. 1 and 2 or the separate screen grids 32 may be deployed in a somewhat staggered manner as shown in FIGS. 22 and 23. In this embodiment the stanchions are deployed in sets including at least two end stanchions 31' and 31 and 31 and 31". Although not shown in the drawing figure, intermediate stanchions may be used between each of the end stanchions. As shown, the first screen grid extending from the shoreline is not in exact alignment with the second screen grid although, in some embodiments it may be.

To further rigidify the drawing structure as shown in FIGS. 22 and 23, the adjacent stanchions 41 of the separate screen grids 32 may be connected such as by adjustable band clamps 56 and 57. The band clamps 56 are shown as being placed about the intermediate stanchions 31 which are adjacent to one another and, in some embodiments, other band clamps may be placed along the lower portion of the stanchion. In the drawing figure, a separate band clamp 57 is shown as being mounted about the sleeves of the adjacent stanchions 31. In some embodiments a plurality of secondary clamps may be used to secure the adjacent stanchions to one another. By connecting or securing the adjacent stanchions to one another a force directed against one stanchion is offset by the adjacent stanchion thereby further rigidifying and reinforcing the overall groyne structure.

Figure 9:
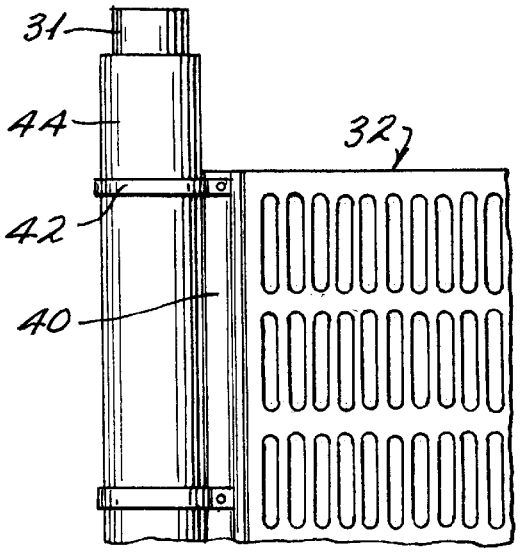
FIG. 9 is a partial front plan view showing a first form of grid pattern or mesh configuration for a screen of the invention.

With specific reference to FIGS. 9–13, variations of screen grids are illustrated. It should be noted that the openings 39 in the grids may be elongated and somewhat oblong as shown in FIG. 9 in a vertical direction or may be elongated in a horizontal direction as shown in FIG. 1. Further, the dimension of the openings may vary such as shown in FIGS. 9–13 or the openings may be non-uniform as exemplified by a further embodiment of the invention shown in FIG. 14.

Figure 10:
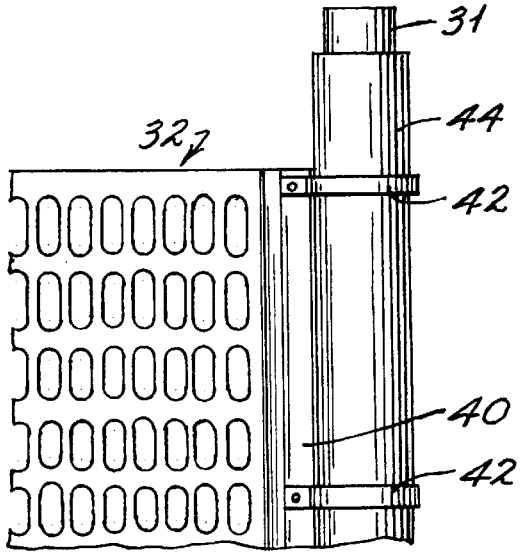
FIG. 10 is a partial front plan view showing an alternate embodiment of mesh configuration for screens of the invention.
Figure 11:
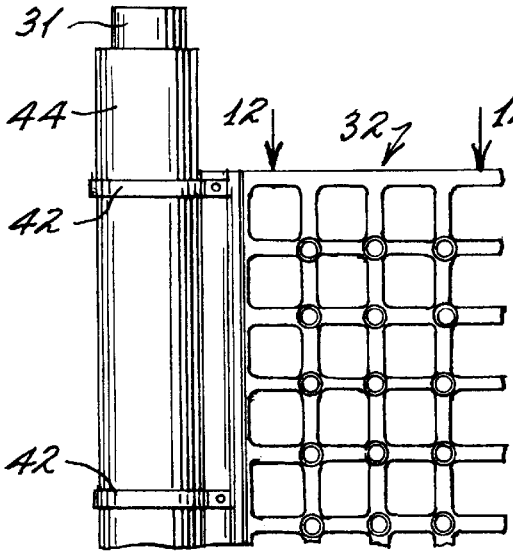
FIG. 11 is a partial front plan view of yet another embodiment of mesh configuration for use with the invention.
Figure 13:
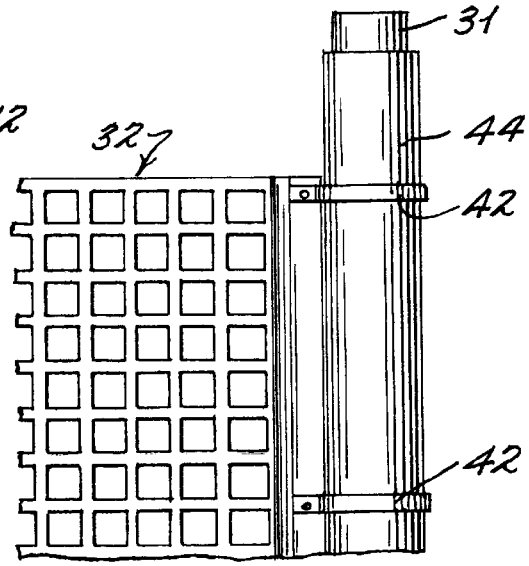
FIG. 13 shows a biaxial strengthened screen grid for use with the invention.
Figure 12:
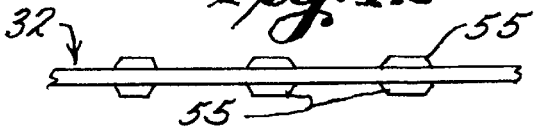
FIG. 12 is a partial top plan view showing the reinforcement of the screen grid of FIG. 11.

The structure shown in FIGS. 11 and 13 provide somewhat rectangular openings. Such grid structures are generally biaxial loaded so as to provide the same strength horizontally as vertically whereas structures such as shown in FIGS. 9 and 10 tend to be somewhat uniaxially loaded so as to provide greater strength in one direction over another. As shown in FIG. 12, some of the screen grid structures are molded or extruded so that they are reinforced at intersections of their horizontal and vertical components as shown at 55 in the drawing figure.

Figure 14:
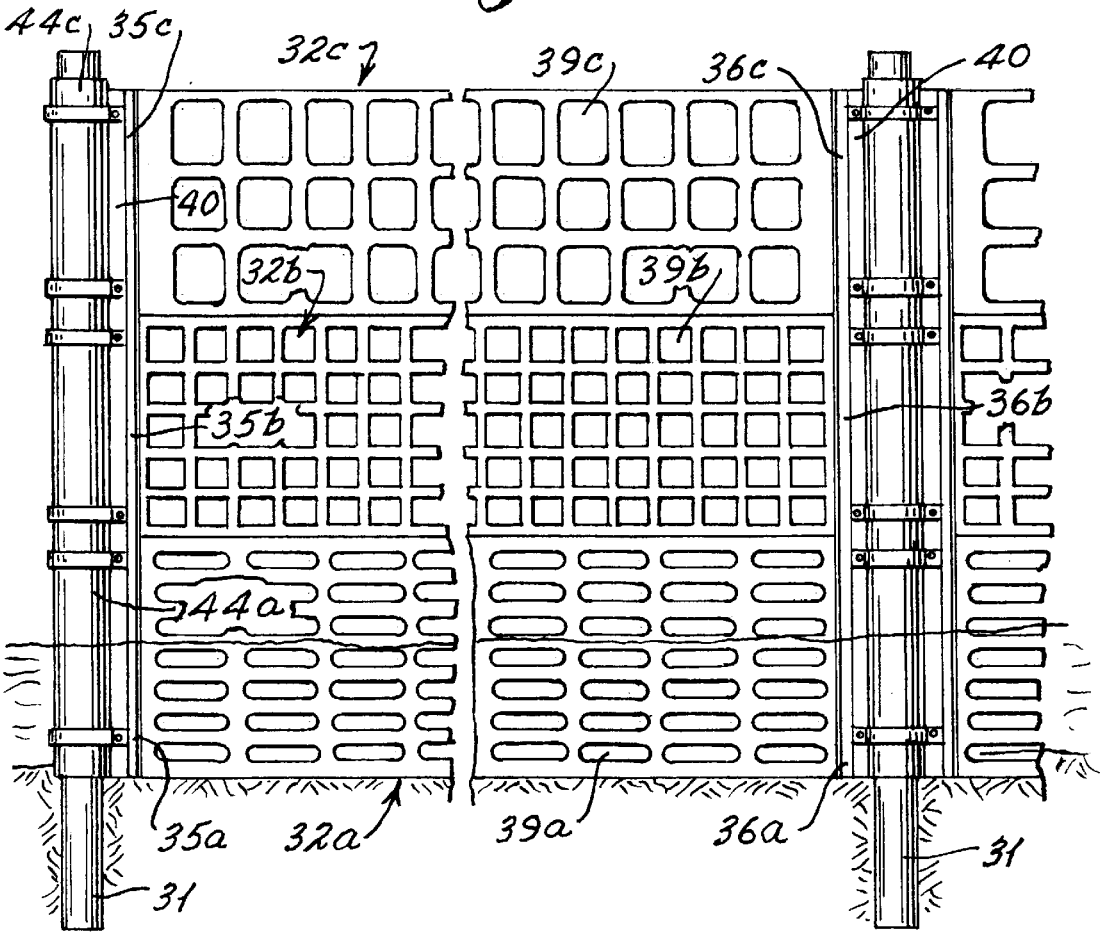
FIG. 14 is a partial front plan view of another embodiment of the invention showing separate vertical screens sections mounted to end stanchions by way of separately moveable supporting sleeves.
Figure 15:
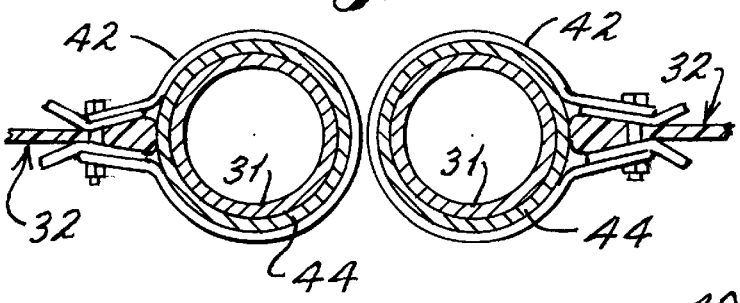
FIG. 15 is a cross-sectional view taken from above of a pair of spaced stanchions showing adjacent screens being mounted to separate stanchions by way of sleeves mounted to the spaced stanchions in a manner similar to the structure of FIG. 17.

With particular reference to FIG. 14, another embodiment of the present invention is shown in greater detail. In this embodiment, each of the screens is divided into a plurality of vertical sections 32*a*, 32*b*, and 32*c* respectively. As shown, the openings 39*a*, 39*b* and 39*c* in the three vertically related screen sections are of differing size and configuration. Generally, it would be preferred that the openings 39*a* be smaller and therefore more dense then the number of openings in the screen sections 32*b* and 32*c*. Although three sections are shown in the drawings figures, two or more sections may be used.

To facilitate the vertical movement of each of the screen sections, the end edges 35*a* and 36*a* of screen section 32*a* are mounted to separate spaced sleeves 44*a* whereas the end edges 35*b* and 36*b* of section 32*b* are mounted to a separate sleeves 44*b*. Likewise, the ends 35*c* and 36*c* of the uppermost screen section 32*c* are mounted to uppermost sleeves 44*c*.

With this embodiment, if it becomes necessary to elevate the screens, the uppermost screens can be removed once they are no longer needed leaving the lower screens in place such that the lower screens rest along newly deposited material.

As opposed to utilizing a plurality of separate screen sections to create different mesh openings, the present invention also contemplates creating different mesh openings by mounting separate screen grids in overlapping or face-to-face relationship. In this respect, in FIGS. 17–19, a groyne structure 130 is shown wherein a secondary screen 132 having smaller mesh openings 139 is clamped in face-to-face relationship along the lower portion of a primary screen grid 32. By clamping the screens together in a manner as disclosed with respect to the previous embodiments, the openings along the lower portion of the screen can be varied as is needed. In the embodiment, the screens are shown as being clamped to the stanchions using split sleeves.

Although not shown in the drawings, but as previously discussed, each screen grid may also be formed with mesh openings of different sizes such that the density of the openings decreases from the bottom to top with the smallest openings therefore being along the lower portion thereof.

In use, the material from which the screens of the invention are made allows the groynes to be left in place after deployment for indefinite periods of time. The material is strong enough to withstand heavy storm surges and will not deteriorate by exposure to salt water or to ultra-violet light. As waves pass through the openings created within the screens, particulate material will be deposited along the base of the screen. As material continues to build-up, it is also possible to selectively elevate the screens and/or the stanchions of the present invention such that the bottom of the screens can be adjusted so as to be positioned adjacent an upper surface of newly deposited materials. The structure can also be easily removed once a predetermined amount of material has been reclaimed.

The structure of the groynes of the present invention provides an advantage over prior art structures in that the screens are not easily damaged as are screens which are formed of more conventional flexible netting material. Therefore, there are fewer costs involved with maintenance of a deployed groyne.

Figure 24:
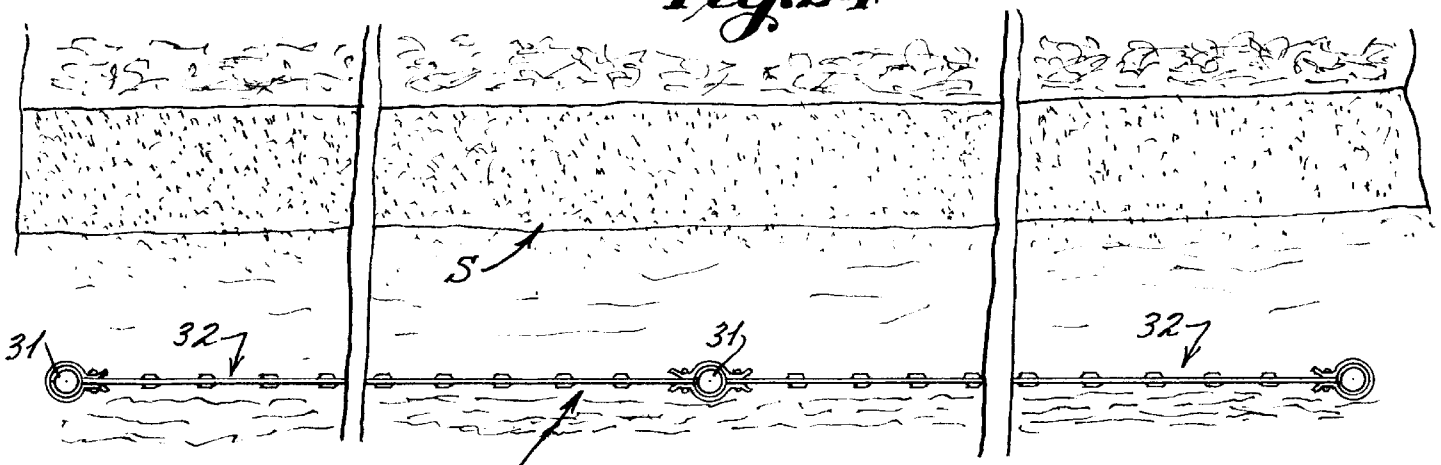
FIG. 24 is a top plan illustrational view showing one of the groyne structures deployed as a porous breakwater extending generally parallel to a shoreline so as to dissipate wave energy as waves approach the shoreline.
Figure 25:
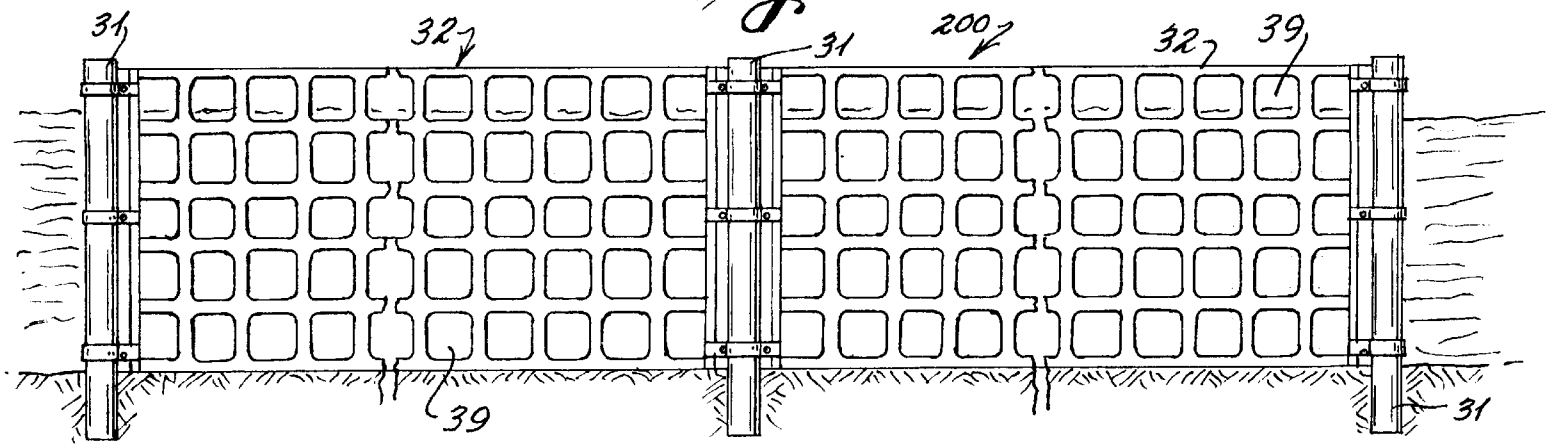
FIG. 25 is a front plan view of the porous breakwater shown in FIG. 24.

With specific reference to FIGS. 24 and 25, a further embodiment of the present invention is shown wherein the screens and stanchions are used to create a porous breakwater 200. The breakwater differs in its deployment and its purpose from the porous groynes. The breakwater is provided so as to extend somewhat parallel to a seashore "S" to create a barrier which breaks wave action and, thereby reduces the damaging effect of wave impact on material along the shoreline. With the present invention, the screen material is sufficiently strong and yet may be made selectively porous to create a desired dissipation of wave energy. The structure includes a plurality of stanchions or posts 31 which are embedded in spaced relationship along a line extending generally parallel to the seashore as shown. Thereafter, utilizing the mounting elements of the present invention as previously described, the screens 32 are secured to the stanchions such that they extend generally to the high tide line although in some instances the structure may be constructed so as to be deployed below the normal low tide line but spaced outwardly from the shore. As waves approach the shore they must pass through the openings 39 within the structure and, depending upon the size of the openings, the energy of the wave action can be reduced thereby further facilitating beach build-up by reducing the effect that normal wave action would have with respect to material along the shoreline.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. A porous groyne for land reclamation comprising a plurality of pairs of spaced end stanchions and a plurality of self supporting screen grids, each of said screen grids having an upper portion, lower portion and opposite ends and having a plurality of spaced horizontal and vertical components which are integrally formed with one another so as to define a plurality of openings therebetween through which fluid and fluid conveyed solids may pass, said screen grids being formed of a material selected from a group of materials consisting of high density polyethylene, polypropylene, polymers, co-polymers, polymer mixtures and laminates thereof, and securing means for securing said opposite ends of each of said screen grid relative to a spaced pair of said plurality of pairs of said end stanchions such that said screen grids are substantially rigid between said end stanchions.

2. The porous groyne of claim 1 including at least one intermediate stanchion positioned between at least one of said pairs of end stanchions to which one of said screen grids is selectively secured.

3. The porous groyne of claim 2 wherein at least one of said screen grids includes a plurality of second openings therein of a size to selectively receive said at least one intermediate stanchion such that said at least one screen grid is secured by interweaving said at least one intermediate stanchion through said second openings.

4. The porous groyne of claim 2 including another securing means for selectively securing said one of said screen grids to said at least one intermediate stanchion.

5. The porous groyne of claim 1 in which said securing means for securing said plurality of screen grids includes at least one sleeve mounted to each of said end stanchions, said sleeves being of a size to be slidably movable with respect to said end stanchions, and second securing means for securing said opposite ends of said screen grids to said sleeves.

6. The porous groyne of claim 5 wherein at least one of said sleeves is formed as a split sleeve having a tubular body member having a pair of spaced integrally formed flanges in spaced relationship with respect to one another between which an end of one of said screen grids is disposed.

7. The porous groyne of claim 5 wherein at least one of said sleeves includes a tubular body portion having at least one flange element extending outwardly therefrom to which an end of one of said screen grids is secured.

8. The porous groyne of claim 1 in which at least one of said screen grids includes a plurality of non-uniform openings and wherein openings adjacent said lower portion are smaller in dimension than those adjacent said upper portion.

9. The porous groyne of claim 1 in which at least one of said screen grids includes a plurality of vertical sections, and means for independently mounting each of said vertical sections to said spaced end stanchions whereby said plurality of vertical sections are independently movable relative to said end stanchions.

10. The porous groyne of claim 1 wherein at least one of said screen grids includes a pair of screen grids mounted in opposing and face-to-face relationship in such a manner that openings in each of said screen grids are offset in alignment relative to one another in facing relationship to thereby vary an effective opening size between said pair of screen grids.

11. The porous groyne of claim 1 wherein a first stanchion of a first of said plurality of pairs of end stanchions is disposed proximate to a second stanchion of a second of said plurality of pairs of end stanchions, and connecting means for connecting said first and second stanchions to one another.

12. The porous groyne of claim 1 in which said screen grids are formed of a Tensar Geo-grid® material.

13. The porous groyne of claim 1 in which said securing means for securing said plurality of screen grids includes a plurality of sleeves, each of said sleeves being elongated so as to extend along a substantial portion of said end stanchions.

14. A porous groyne for land reclamation comprising a plurality of spaced stanchions and at least one self supporting screen grid, said at least one screen grid having an upper portion, lower portion and opposite ends and having a plurality of spaced horizontal and vertical components which are integrally formed with one another so as to define a plurality of openings therein through which fluid and fluid conveyed solids may pass, said at least one screen grid being formed of a material selected from a group of materials consisting of high density polyethylene, polypropylene, polymers, co-polymers, polymer mixtures or laminates thereof and securing, and means for securing said opposite ends of said at least one screen grid relative to spaced stanchions such that said at least one screen grid is substantially rigid between said spaced stanchions.

15. The porous groyne of claim 14 in which said securing means for securing said at least one screen grid includes at least one sleeve mounted to each of said spaced stanchions, said sleeves being of a size to be slidably movable with respect to said spaced stanchions, and second securing means for securing said opposite ends of said at least one screen grid to said sleeves.

16. The porous groyne of claim 15 in which said sleeves are elongated so as to extend along a substantial portion of said spaced stanchions.

17. The porous groyne of claim 14 in which said at least one screen grid is formed of a Tensar Geo-grid® material.

* * * * *